United States Patent [19]

Okamoto et al.

[11] Patent Number: 4,887,504

[45] Date of Patent: Dec. 19, 1989

[54] AUTOMATIC ACCOMPANIMENT APPARATUS REALIZING AUTOMATIC ACCOMPANIMENT AND MANUAL PERFORMANCE SELECTABLE AUTOMATICALLY

[75] Inventors: Eisaku Okamoto; Yasunao Abe, both of Hamamatsu, Japan

[73] Assignee: Yamaha Corporation, Hamamatsu, Japan

[21] Appl. No.: 101,657

[22] Filed: Sep. 28, 1987

[30] Foreign Application Priority Data

Sep. 29, 1986 [JP] Japan ..... 61-230913

[51] Int. Cl.[4] ..... G10F 1/00; G10H 1/00

[52] U.S. Cl. ..... 84/715; 84/DIG. 12

[58] Field of Search ..... 84/1.03, DIG. 22, DIG. 12, 84/1.01, 1.17

[56] References Cited

U.S. PATENT DOCUMENTS 4,144,788 3/1979 Bione et al. ..... 84/1.03 X
4,216,692 8/1980 Okuyama et al. ..... 84/1.01
4,300,430 11/1981 Bione et al. ..... 84/1.01
4,399,731 8/1983 Aoki ..... 84/470 R X
4,708,046 11/1987 Kozuki ..... 84/1.03

FOREIGN PATENT DOCUMENTS 0039464 11/1981 European Pat. Off. ..... 84/1.03
59-140495 9/1984 Japan .

*Primary Examiner*—A. T. Grimley
*Assistant Examiner*—Matthew S. Smith
*Attorney, Agent, or Firm*—Spensley Horn Jubas & Lubitz

[57] ABSTRACT

For use in or with an electronic musical instrument, an automatic accompaniment apparatus has a keyboard, a chord detector detecting a chord played on the keyboard, a judging circuit judging chord establishment of the detector chord, and a chord accompaniment tone generator producing, in accordance with an automatic rhythm pattern, chord tones for the detected chord when chord establishment is judged. This apparatus further comprises a tone generator for producing the tones of arbitrarily depressed keys when chord establishment is not judged. Thus, automatic accompaniment and manual performance are automatically selected according to the state of key depressions.

3 Claims, 12 Drawing Sheets

12 BITs

| PTN | B | A# | A | G# | G | F# | F | E | D# | D | C# | C | |
|---|---|---|---|---|---|---|---|---|---|---|---|---|---|
| 0 | 0 | 0 | 0 | 0 | 1 | 0 | 0 | 1 | 0 | 0 | 0 | 1 | (M) |
| 1 | 0 | 0 | 0 | 0 | 1 | 0 | 0 | 0 | 0 | 0 | 0 | 1 | (M) |
| 2 | 0 | 0 | 0 | 0 | 1 | 0 | 0 | 0 | 1 | 0 | 0 | 1 | (m) |
| 3 | 0 | 1 | 0 | 0 | 1 | 0 | 0 | 1 | 0 | 0 | 0 | 1 | (7th) |
| 4 | 0 | 1 | 0 | 0 | 0 | 0 | 0 | 1 | 0 | 0 | 0 | 1 | (7th) |
| 5 | 1 | 0 | 0 | 0 | 1 | 0 | 0 | 1 | 0 | 0 | 0 | 1 | (M7) |
| 6 | 1 | 0 | 0 | 0 | 0 | 0 | 0 | 1 | 0 | 0 | 0 | 1 | (M7) |
| 7 | 0 | 1 | 0 | 0 | 1 | 0 | 0 | 0 | 1 | 0 | 0 | 1 | (m7) |
| 8 | 0 | 1 | 0 | 0 | 0 | 0 | 0 | 0 | 1 | 0 | 0 | 1 | (m7) |
| 9 | 0 | 1 | 0 | 0 | 1 | 0 | 1 | 0 | 0 | 0 | 0 | 1 | (SUS 4) |
| 10 | 0 | 1 | 0 | 0 | 0 | 1 | 0 | 0 | 0 | 0 | 0 | 1 | ($m7^{-5}$) |

FIG. 3

| PTN | CTN | |
|---|---|---|
| 0 | 1 | M |
| 1 | 1 | |
| 2 | 2 | m |
| 3 | 3 | 7th |
| 4 | 3 | |
| 5 | 4 | M7 |
| 6 | 4 | |
| 7 | 5 | m7 |
| 8 | 5 | |
| 9 | 6 | SUS 4 |
| 10 | 7 | $m7^{-5}$ |

FIG. 4

| CTN | $T_1$ | $T_2$ | $T_3$ | |
|---|---|---|---|---|
| 0 | 0 | 4 | 7 | NOT ESTABLISHED |
| 1 | 0 | 4 | 7 | M |
| 2 | 0 | 3 | 7 | m |
| 3 | 0 | 4 | 10 | 7th |
| 4 | 0 | 4 | 11 | M7 |
| 5 | 0 | 3 | 10 | m7 |
| 6 | 0 | 5 | 7 | SUS 4 |
| 7 | 0 | 6 | 10 | $m7^{-5}$ |

FIG. 5

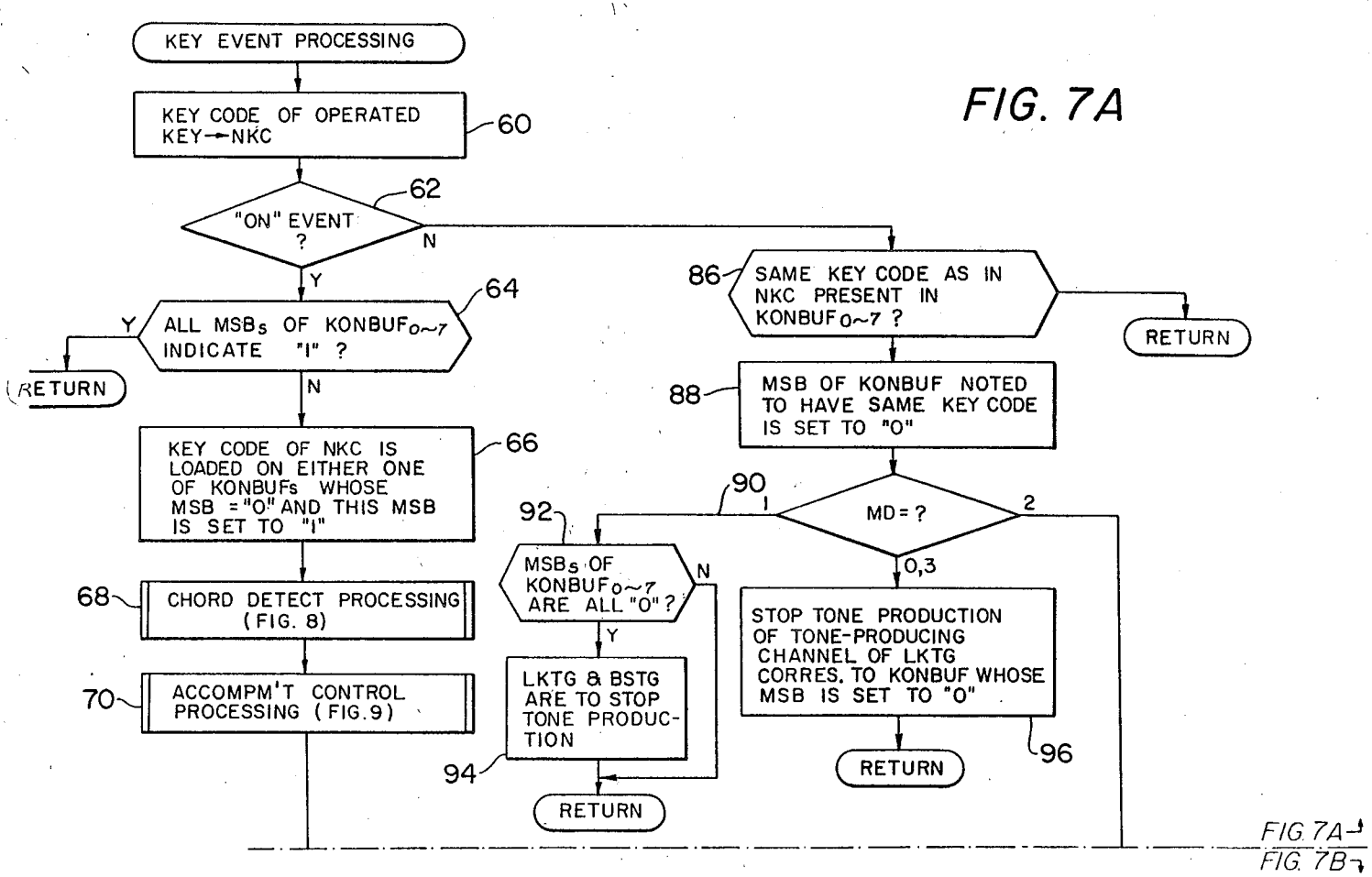
KEY EVENT PROCESSING
KEY CODE OF OPERATED KEY→NKC
60
"ON" EVENT ?
62
N
Y
ALL MSBs OF KONBUF0~7 INDICATE "1" ?
64
Y
RETURN
N
KEY CODE OF NKC IS LOADED ON EITHER ONE OF KONBUFs WHOSE MSB = "0" AND THIS MSB IS SET TO "1"
66
CHORD DETECT PROCESSING (FIG. 8)
68
ACCOMPM'T CONTROL PROCESSING (FIG. 9)
70
SAME KEY CODE AS IN NKC PRESENT IN KONBUF0~7 ?
86
RETURN
MSB OF KONBUF NOTED TO HAVE SAME KEY CODE IS SET TO "0"
88
MD = ?
90
1
2
0,3
MSBs OF KONBUF0~7 ARE ALL "0" ?
92
N
Y
LKTG & BSTG ARE TO STOP TONE PRODUCTION
94
RETURN
STOP TONE PRODUCTION OF TONE-PRODUCING CHANNEL OF LKTG CORRES. TO KONBUF WHOSE MSB IS SET TO "0"
96
RETURN
FIG. 7A
FIG. 7B

AUTOMATIC ACCOMPANIMENT APPARATUS REALIZING AUTOMATIC ACCOMPANIMENT AND MANUAL PERFORMANCE SELECTABLE AUTOMATICALLY

BACKGROUND OF THE INVENTION (a) Field of the Invention

The present invention relates to an automatic accompaniment apparatus for use in or with an electronic musical instrument, and more particularly it pertains to an improvement of the performance control on the basis of chord type detection.

(b) Description of the Prior Art

In the past, there has been known an accompaniment apparatus for an electronic musical instrument which is so structured as to be operative that, based on the key depression signals supplied from the accompaniment keyboard (e.g. lower keyboard), a chord type such as major, minor and the like, and a root note are detected, and that, along therewith, based on the accompaniment pattern corresponding to the detected chord type and also on the detected root note, accompaniment tones such as chord tones, bass tones, etc. are generated (see, for example, Japanese Patent Preliminary Publication No. Sho 59-140495). And, in the automatic accompaniment apparatus of the above-mentioned type, it has been the usual practice to provide an automatic bass chord (ABC) mode selection switch so that, only when this selection switch is turned on, automatic accompaniment controlling via the accompaniment keyboard is made feasible.

According to the above-mentioned prior art, however, it should be noted that, in the state the ABC mode selection switch has been turned on, there arises such an inconvenience that, even when a melody, for example, is played on the accompaniment keyboard, there are produced only the specific chord tones or like tones (which tones are not stopped of their production even by release of the depressed keys) for the reasons that no chord has been established, and therefore, the player is no longer able to play a melody, hence the drawback that the expressions of performance are restricted.

Also, in case it is intended to generate musical tones as per the key depressions which the player performs on the accompaniment keyboard, there is in fact no other way for the user but to turn off the ABC mode selection switch (i.e. to release the ABC mode). Engaging oneself in such a switching operation in the midst of a musical performance has constituted a cause for hampering the smooth progression of the performance.

Not only that, in case the ABC mode is released, the automatic accompaniment becomes no longer utilizable, thus sacrificing the richness of performance.

SUMMARY OF THE INVENTION

It is, therefore, an object of the present invention to provide an automatic accompaniment apparatus for use in or with an electronic musical instrument, which allows the generation of automatic accompaniment tones and/or manual performance tones without requiring a manual (separate) switching operation during the course of a performance.

Another object of the present invention is to provide an automatic accompaniment instrument, which is capable of generating arbitrary tones other than the automatic accompaniment tones.

The automatic accompaniment apparatus for an electronic musical instrument according to the present invention is comprised of a keyboard A, chord detector B, judging means C, accompaniment tone generator D and manual tone generator E, as shown in the illustration of FIG. 1 showing the principle of the present invention.

The chord detector B is intended to detect a chord type and a root note based on the key depression signals supplied from the keyboard A. The judging means C is intended to judge whether the chord detector B has detected a predetermined chord type.

The accompaniment tone generator D is intended to generate, when the result of judgment made by the judging means C is affirmative, accompaniment tones in accordance with an accompaniment pattern corresponding to the detected chord type.

The manual tone generator E is intended to generate musical scale tones corresponding to the depressed keys based on the key depression signals supplied from the keyboard A when the result of judgment by the judging means C is negative.

In the above-mentioned arrangement of the automatic accompaniment apparatus, the accompaniment tone generator D may be so constructed as to be operative so that when the result of judgment has turned out to be negative, the generation of the accompaniment tones continue exactly with the same accompaniment pattern which had till then been running.

According to the arrangement of the present invention, it is possible to control the generation of automatic accompaniment tones by so depressing the keys as to correspond to the predetermined chord types, and also to generate manual performance tones corresponding to those keys which are so depressed as not to correspond to any of the predetermined chord types, whereby materializing diversified expressions of performance by a combination of automatic accompaniment and manual performance, just by altering the state of key depression and without requiring additional switching operations.

A further object of the present invention is to provide an automatic accompaniment apparatus of the type as mentioned above, which is arranged so that the generation of accompaniment tones are continued throughout the generation of musical tones corresponding to the depressed keys, thereby providing further expression-enriched performances.

As stated above, according to the present invention, arrangement is provided so that a single keyboard can be utilized to materialize each one of the purposes, i.e. control of automatic accompaniment and the generation of manual performance tones, in accordance with the state of key depression, thus providing the advantage that a performance rich in variation can be enjoyed without troublesome complicated switching operations.

Also, by arranging so that automatic accompaniment can be continued during the generation of manual performance tones also, there is provided another advantage that, in case a suspension of automatic accompaniment brings about unnatural feeling for the listeners, such an unnaturalness can be eliminated.

The above objects as well as other objects, the features and advantages of the present invention will become apparent from the detailed description of the preferred embodiment when taken in conjunction with the accompanying drawings.

BRIEF DESCRIPTION OF THE DRAWINGS

FIG. 3 is an illustration showing the contents of the memory of the chord detection table.

FIG. 4 is an illustration showing the contents of the memory of the number conversion table.

FIG. 5 is an illustration showing the contents of the memory of the chord-constituting note table.

FIGS. 7A–B are flow charts showing the key event processing sub-routine.

FIGS. 10A–B are flow charts showing the mode alteration processing sub-routine.

DETAILED DESCRIPTION OF THE PREFERRED EMBODIMENTS

A brief overview will be given before entering into a detailed description of the present invention.

The automatic accompaniment apparatus of the present invention is arranged to be operative so that a chord type is detected based on the key depression signals supplied from the keyboard such as lower keyboard, and along therewith judgment is made as to whether or not a predetermined chord type has been detected, i.e. whether a chord has been established, and if the result indicates "a chord is established", accompaniment tones are generated in accordance with an accompaniment pattern corresponding to the detected chord type and the root note, whereas in case "a chord is not established", musical scale tones corresponding individually to the depressed keys are generated based on the key-depression signals supplied from the keyboard. Thus, according to the present invention, it is possible to control the generation of automatic accompaniment tones or to generate manual performance tones by a mere alteration of the state of key depression, i.e. in accordance with the manner of key depression which does or does not bring about "establishment of a chord type". Thus, a performance which is rich in variation becomes feasible.

Figure 1:
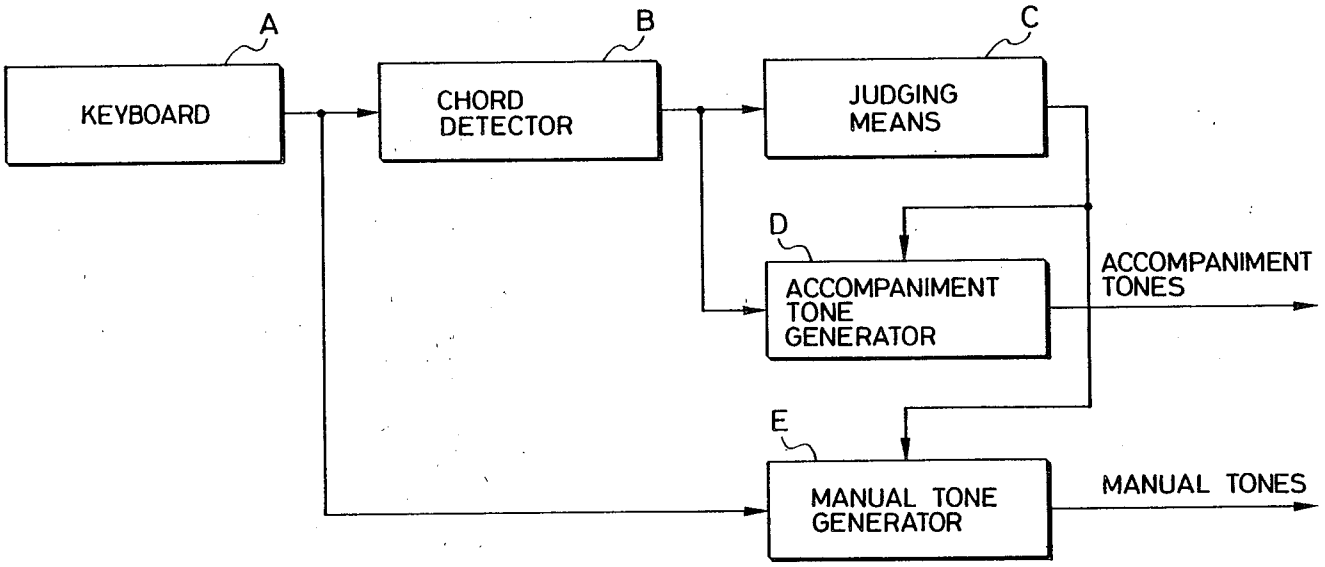
FIG. 1 is a functional block diagram showing the principle of the automatic accompaniment apparatus according to the present invention.
Figure 2:
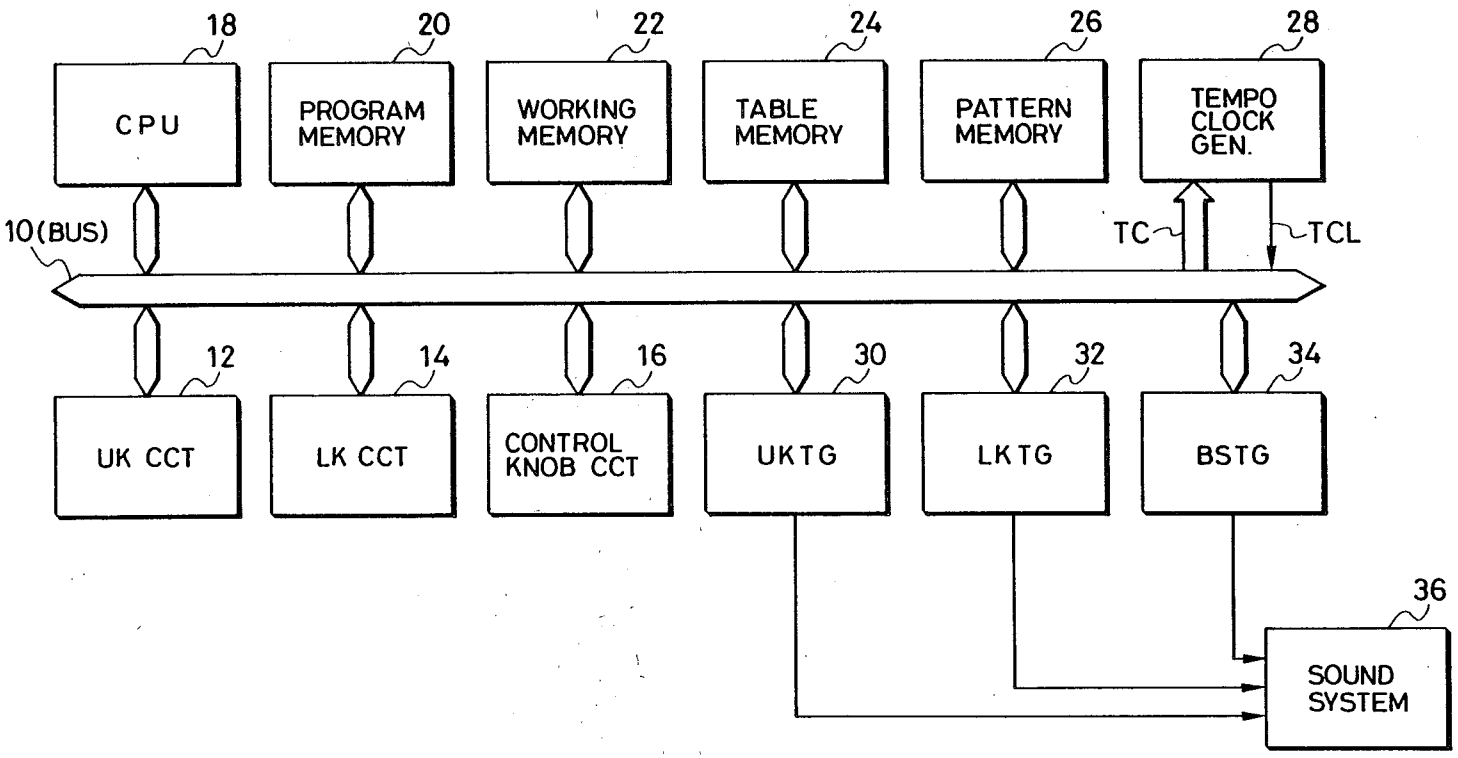
FIG. 2 is a block diagram showing the circuit arrangement of an electronic musical instrument provided with an automatic accompaniment apparatus according to an embodiment of the present invention.

FIG. 2 shows a circuit arrangement of an electronic musical instrument provided with an automatic accompaniment apparatus according to an embodiment of the present invention. This electronic musical instrument is so constructed that the generation of various musical tones such as melody tones, chord tones, bass tones, rhythm tones and like tones is controlled by a micro/computer.

Circuit Arrangement (FIG. 2)

To a bus 10 are connected an upper keyboard (UK) circuit 12, a lower keyboard (LK) circuit 14, a control knob circuit 16, a central processing unit (CPU) 18, a program memory 20, a working memory 22, a table memory 24, a pattern memory 26, a tempo clock generator 28, a UK tone generator (UKTG) 30, an LK tone generator (LKTG) 32, a bass tone generator (BSTG) 34, etc.

The UK circuit 12 includes an upper keyboard which is used for melody playing or like playing. Arrangement is provided so that key depression signal is detected for each key of this upper keyboard.

The LK circuit 14 includes a lower keyboard which is used for accompaniment playing and like purposes, and is so constructed that for each key of this lower keyboard, its key depression signal is detected.

The relationship between the note pitches and the key codes with respect to the keys of both the upper keyboard and the lower keyboard is preliminarily determined as follows.

| | | | |
|---|---|---|---|
| Note pitch: | $C_2 \ldots B_2$ | $C_3 \ldots B_3$ | $C_4 \ldots$ |
| Key code: | 36 . . . 47 | 48 . . . 59 | 60 . . . |
| Note pitch: | $C_5 \ldots C_6 \ldots C_7$ | | |
| Key code: | 72 . . . 84 . . . 96 | | |

The control knob circuit 16 includes tone property control knobs for controlling tone color, tone volume, effect and so forth, and also performance control knobs for controlling such automatic performances as automatic rhythm performance, automatic bass chord performance, etc. Arrangement is provided so that the information concerning the manipulation of knobs is detected for each control knob. As the performance control knobs related to the practicing of the present invention, there are provided a rhythm start switch, rhythm selection switches, a tempo adjusting variable resistor, mode selection switches, etc. As the mode selection switches, there are provided one for selecting the normal mode (Mode 0), one for selecting the ordinary ABC mode (Mode 1), one for selecting manual bass mode (Mode 2), and one for selecting the manual chord mode (Mode 3). Here, the respective contents of these modes will be briefed as follows.

(1) Normal Mode (Mode 0)

This is a mode for generating manual performance tones by LKTG 32 individually as per the performance key operation conducted on the lower keyboard.

(2) Ordinary ABC Mode (Mode 1)

This is a mode for generating automatic chord tones and automatic bass tones by LKTG 32 and BSTG 34, respectively, in accordance with a chord pattern and a bass pattern, respectively.

(3) Manual Bass Mode (Mode 2)

This is a mode for generating automatic chord tones by LKTG 32 in accordance with a chord pattern on the one hand, and for generating, on the other hand at the time a chord is not established, manual bass tones by BSTG 34 in compliance with the key depression done on the lower keyboard.

(4) Manual Chord Mode (Mode 3)

This is a mode for generating automatic bass tones by BSTG 34 in accordance with a bass pattern on the one hand, and for generating, on the other hand at the occasion when a chord is not established, manual performance tones by LKTG 32 in compliance with the individual key depressions on the lower keyboard.

The CPU 18 is designed to carry out control and processing for the generation of various kinds of musical tones in accordance with the program stored in the program memory 20. With respect to these kinds of processing mentioned above, their description will be made later by referring to FIGS. 6 to 12.

The working memory 22 includes those memory regions which are utilized to serve as registers, flags, counters, etc. when various kinds of processing are carried out by CPU 18. The details of these memory regions will be described later.

The table memory 24 includes a chord detection table, a number conversion table, a chord constituent note table, etc. The memorized contents of these tables are shown exemplarily in FIGS. 3 to 4.

The chord detection table is for use in the detection of a chord type based on the key depression signals supplied from the lower keyboard. As shown by way of example in FIG. 3, there are stored eleven (11) kinds of chord detecting patterns as noted from pattern number PTN="0"~"10". Each chord detection pattern is expressed by twelve (12)-bit data corresponding to the twelve (12) note names of C, C#, . . . , B. As the pattern for detecting, for example, "major" M, there are used the data having its three (3) bits corresponding to C, E, G are each "1", or the data having its two (2) bits corresponding to C, E are each "1". FIG. 3 shows, in parentheses on the extreme right side of illustration, those chord types which can be detected for each pattern. There are here provided a total of seven (7) kinds of chord types that can be detected.

The number conversion table is used to convert a pattern number PTN to a chord type number CTN. As shown by way of example in FIG. 4, there are stored chord type numbers CTN (either one of "1"~"7") corresponding to detectable chord types for each of the respective pattern numbers PTN ranging from "0" to "10". By this pattern number conversion table, the pattern number of, for example, "0" or "1" is converted to the chord type number "1" corresponding to "major" M.

The chord constituent note table is utilized for enabling the production of three (3) tones when Mode 1 (usually ABC mode) is selected and when a rhythm is not running. As shown by way of example in FIG. 5, there are stored note interval data for three (3) tones (notes) $T_1 \sim T_3$ for each of the chord type numbers CTN of "0"~"7". Here, each note interval datum represents the number of semitones counted from a given root note. Also, the chord type number CTN="0" represents that the chord type of the depressed keys does not belong to any one of the chord types of "1"~"7", i.e. it represents the instance that "a chord is not established".

The pattern memory 26 stores accompaniment patterns such as chord pattern, bass pattern, rhythm pattern, etc. Let us here assume that the tempo counter which will be described later takes a count value of "0"~"63" for every two (2) bars (measures). Then, as the respective accompaniment patterns, there are used accompaniment patterns running for two (2) bars.

The chord patterns are stored in an amount up to the number of the chord types for each kind of rhythm. A chord pattern corresponding to an arbitrary kind of rhythm, e.g. waltz, and also corresponding to an arbitrary chord type such as "major" is comprised of a pattern for three (3) notes. The pattern for each note is comprised of a train of data indicating which note located how far (what interval) counted from the root note is to be started or stopped of its sounding at which timing among the sounding-out timings corresponding to the count values "0"~"63" of the tempo counter. In this case, the interval from the root note is expressed by the number of the semitones counted from the root note.

The bass patterns are stored for an amount corresponding to the chord types for every kind of rhythm. A bass pattern corresponding to an arbitrary rhythm kind and to an arbitrary chord type is comprised of a train of data indicating which note located how far from the root note is to be started or stopped of its sounding at what timing among those sounding-out timings corresponding to the count values "0"~"63" of the tempo counter. In this case, too, the intervals from the root note are expressed by the number of semitones counted from the root note.

The above-mentioned chord patterns and bass patterns are such that their contents of accompaniment are determined in compliance with the rhythm kind. Therefore, the automatic accompaniment tones such as chord tones, bass tones, etc. can be sounded out in a form of a rhythmic beat pattern.

The rhythm pattern is stored for every rhythm kind. The rhythm pattern corresponding to an arbitrary rhythm kind is comprised of a train of data indicating which percussion-instrument tones are to be sounded out at what timing among those sounding-out timings corresponding to the count values "0"~"63" of the tempo counter. In FIG. 2, the illustration of the rhythm tone generator for generating rhythm tones in accordance with the rhythm pattern is omitted.

The tempo clock generator 28 is intended to generate a tempo clock signal TCL in compliance with the tempo control data TC. The value of the tempo control data TC is variably set by the tempo adjusting variable resistor which is provided in the control knob circuit 16 as mentioned previously herein with reference to FIG. 2. The frequency of the tempo clock signal TCL corresponds to the tempo set by the above-mentioned variable resistor.

The respective pulses of the tempo clock signal TCL are utilized as the interrupt command signals for commencing the interrupt routine which will be described later by referring to FIG. 12. Also, during the running of a rhythm, the tempo counter counts the pulses of the tempo clock signal TCL.

The UKTG 30 is intended to generate musical tone signals such as melody tones corresponding to the performance operation done on the upper keyboard, based on the key depression signals supplied from the UK circuit 12.

The LKTG 32 is intended to generate such musical tone signals as chord, etc. corresponding to the performance operation conducted on the lower keyboard, based on the key depression signals supplied from the LK circuit 14, or to generate an automatic chord tone signals in accordance with the chord pattern selected by the pattern memory 26, and this LKTG 32 has eight (8) tone-producing channels.

The BSTG 34 is intended to generate bass tone signals corresponding to the performance operation on the lower keyboard, based on the key depression signals supplied from the LK circuit 14, or to generate automatic bass tone signals in accordance with the bass pattern selected through the pattern memory 26.

The sound system 36 is intended to convert to audible sounds various kinds of musical tone signals supplied from UKTG 30, LKTG 32, BSTG 34, a tone generator for rhythms (not shown) or like tone generators.

REGISTERS OF THE WORKING MEMORY

Among the registers provided in the working memory 22, those related to the practicing of the present invention are enumerated as below.

(1) Tempo Counter CLK

This is intended to count the pulses of the tempo clock signal TCL. It takes count values ranging from "0" to "63" for a given length of music within two (2) bars. It is reset to "0" at the timing of reaching "64", i.e. at the end of two (2) bars.

(2) New Key Code Register NKC

This is to store those key codes corresponding to the depressed keys, each time when a fresh key depression takes place.

(3) Bass Key Code Register BKC

This is a register for storing key codes corresponding to the bass tones which are to be sounded out. In accordance with the key codes stored therein, the generation of musical tone signals of BSTG 34 is controlled.

(4) Lowest Pitch Note Key Code Register LKC

This is to store those key codes corresponding to the key of the lowest pitch note among those depressed keys.

(5) Buffer Register For Key Codes KC

This is to temporarily store key codes at the time of calculation, etc.

(6) Note Register NOTE

This is to store note name data. Note name data are to assume either one of the values "0", "1", . . . , "11" in compliance to the twelve (12) note names C, C#, . . . , B, respectively.

(7) Mode Register MD

This is to store mode data indicative of either one of the performance modes of "0"~"3" described earlier.

(8) Rhythm Run/Stop Flag RUN

This is a one (1)-bit register wherein "1" is stored in case a rhythm is running, and "0" is stored when the rhythm is stopped.

(9) First Chord Type Register TYP

This is to store chord type data indicative of the chord type determined based on the state of key depression on the lower keyboard. The chord type data is to assume either one of the values of "0"~"7".

(10) Second Chord Type Register CHDTYP

This is to store chord type data which are used in the controlling of automatic accompaniment.

(11) First Root Note Register ROOT

This is to store the root note data indicative of the root note determined based on the state of key depression on the lower keyboard. Root note data is to take either one of the values "0", "1", . . . , "11" corresponding to C, C#, . . . , B, respectively.

(12) Second Root Note Register CHDROOT

This is to store the root note data which are used in the controlling of automatic accompaniment.

(13) Note Buffer Register NTBUF

This is a register having memory areas for twelve (12) bits corresponding to the twelve (12) note names C, C#, . . . , B, respectively. If "1" is indicated for each memory area, this means the presence of a depression of a key of the corresponding note name, and if "0", this indicates that there is not depression of key of the corresponding note name.

(14) Key-on Buffer Registers $KONBUF_{0\sim7}$

These eight (8) registers correspond to the eight (8) tone-producing channels, respectively, of LKTG 32. For each of these registers, the MSB (most significant bit) region stores either "1" or "0" which is an information indicative of either key-on or key-off, and the regions other than MSB are to store key codes.

Figure 6:
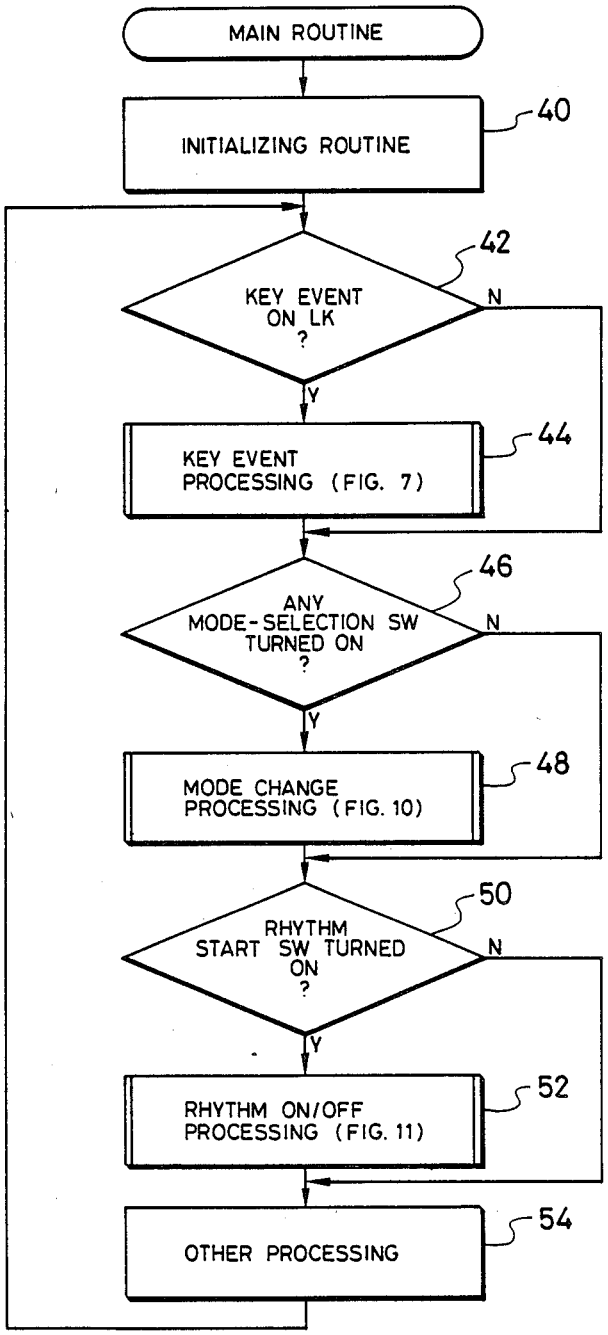
FIG. 6 is a flow chart showing the main processing routine.

Main Routine (FIG. 6)

Next, description will be made of the flow of the main routine processing by giving reference to FIG. 6.

To begin with, in Step 40, initializing routine is carried out to initially set various registers or the like.

With this, processing moves to Step 42, wherein judgment is made whether there is a key event (key-on event or key-off event) on the lower keyboard LK. If the result of this judgment indicates the presence of a key event, (Y), processing moves to Step 44, wherein such a key-event processing as will be described later in connection with FIG. 7 is carried out.

Upon completion of the processing in Step 44, or when the result of judgment in Step 42 is negative, (N), processing moves to Step 46, wherein judgment is made as to whether one of the mode selection switches is turned on. If the result of this judgment indicates that a switch is turned on, (Y), processing moves to Step 48, wherein such a mode alteration processing as will be described later with respect to FIG. 10 is carried out.

Figure 11:
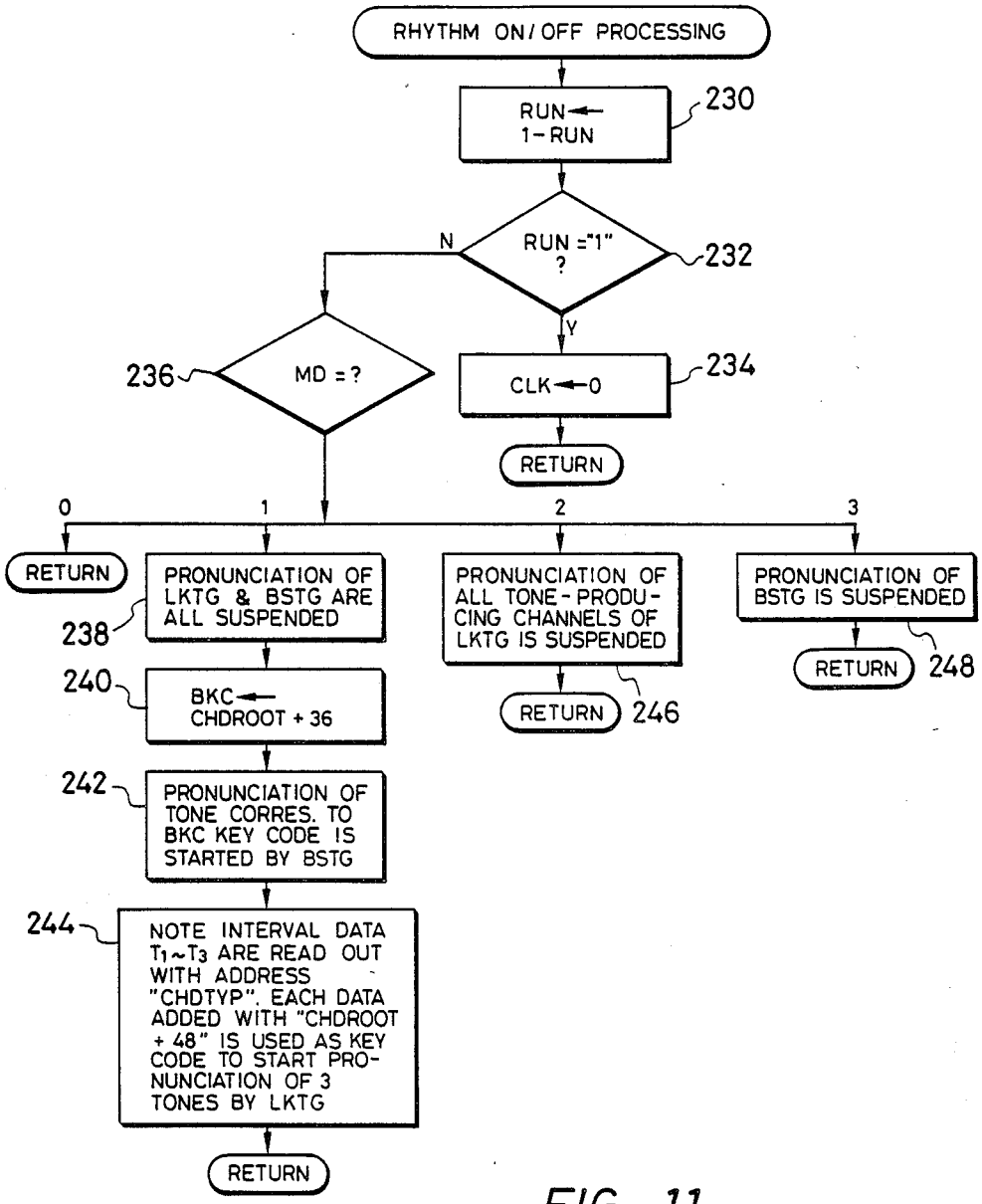
FIG. 11 is a flow chart showing the rhythm on-off processing sub-routine.

When the processing in Step 48 is over, or when the result of judgment in Step 46 is negative, (N), processing moves on to Step 50, wherein judgment is made whether the rhythm start switch is turned on. If the result of this judgment indicates "on", (Y), processing moves to Step 52, wherein such a rhythm on-off processing as will be described later with respect to FIG. 11 is carried out.

When the processing in Step 52 is over or when the result of judgment in Step 50 is negative, (N), processing moves to Step 54, wherein other kinds of processing (such as UK tone generation processing, rhythm selection processing, tempo adjustment processing, etc.) are carried out.

Thereafter, processing returns to Step 42, and those kinds of processing as mentioned above are repeated.

Figure 7B:
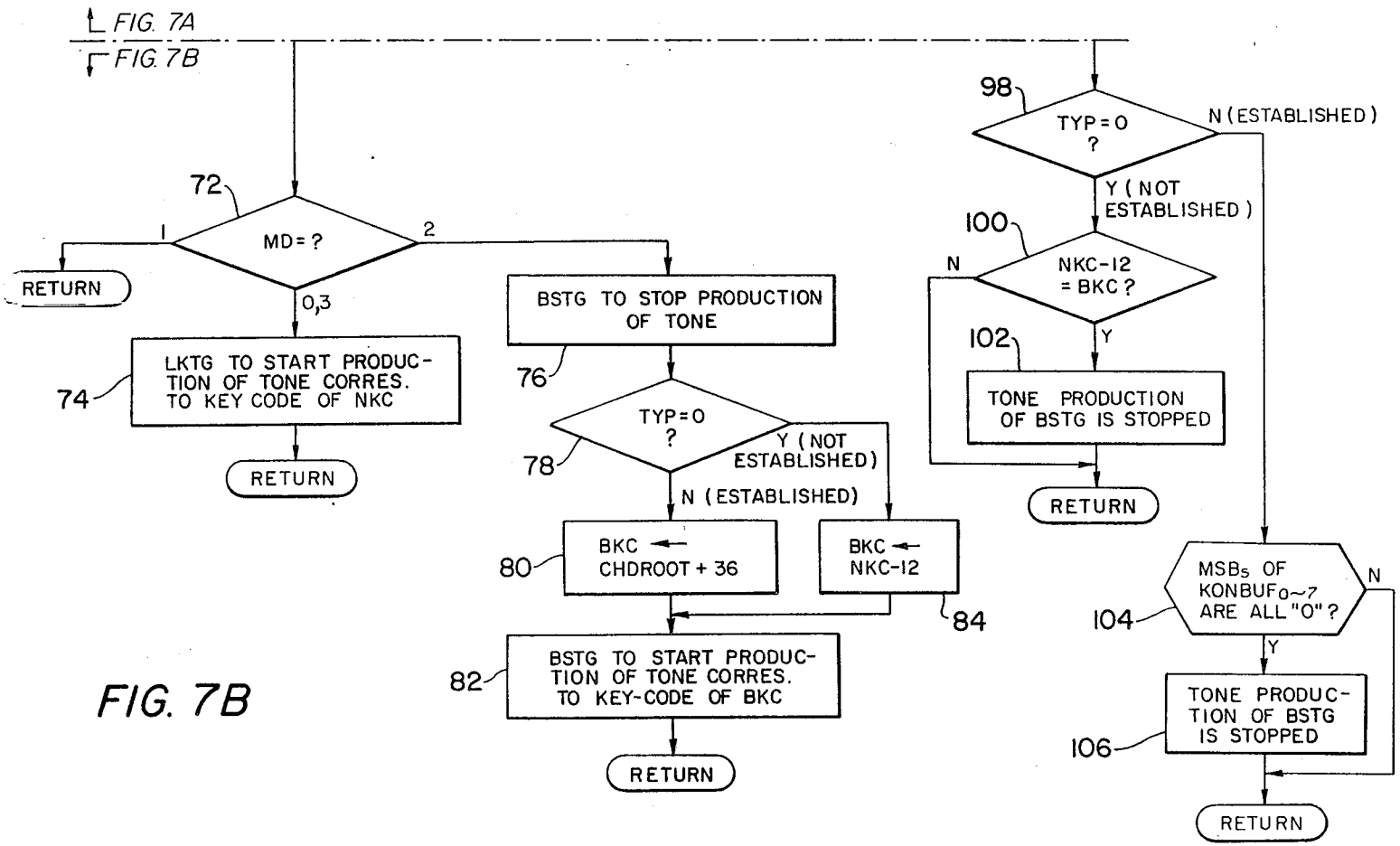

Key Event Processing Sub-routine (FIGS. 7A–B)

FIGS. 7A–B show the flow of the key event processing. In Step 60, the key codes of the operated keys (meaning the keys of which key event has taken place) are loaded in the register NKC.

Next, in Step 62, judgment is made whether the key event is a key-on event. If the result of this judgment indicates a key-on event, (Y), processing moves to Step 64, wherein judgment is made whether MSBs of the registers $KONBUF_{0\sim7}$ are all "1" (meaning whether the eight (8) tone-producing channels are fully occupied). If the result of this judgment is affirmative, (Y), processing returns to the routine of FIG. 6.

In case the result of judgment in Step 64 is negative, (N), this means that, among $KONBUF_{0\sim7}$, there are those having MSB="0" (having empty channel), so that processing moves to Step 66. In this Step 66, key code of NKC is loaded on either one or ones of KONBUFs having MSB="0", and also the MSB of said KONBUF or KONBUFs is set to "1". With this, processing moves on to Step 68.

Figure 8:
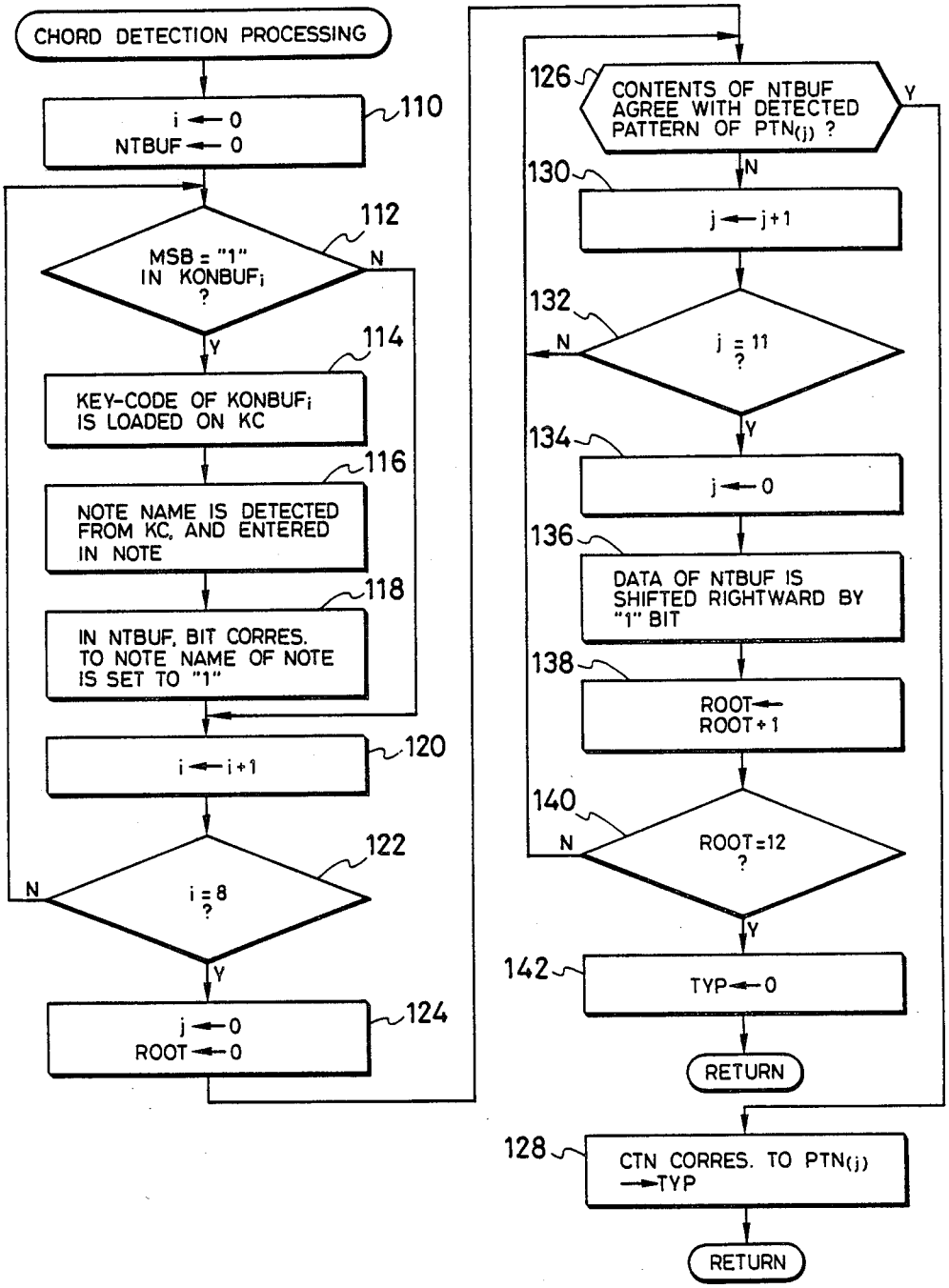
FIG. 8 is a flow chart showing the chord detection processing sub-routine.

In Step 68, such a chord detection processing as will be described with respect to FIG. 8 is carried out, and thereafter processing moves to Step 70.

Figure 9:
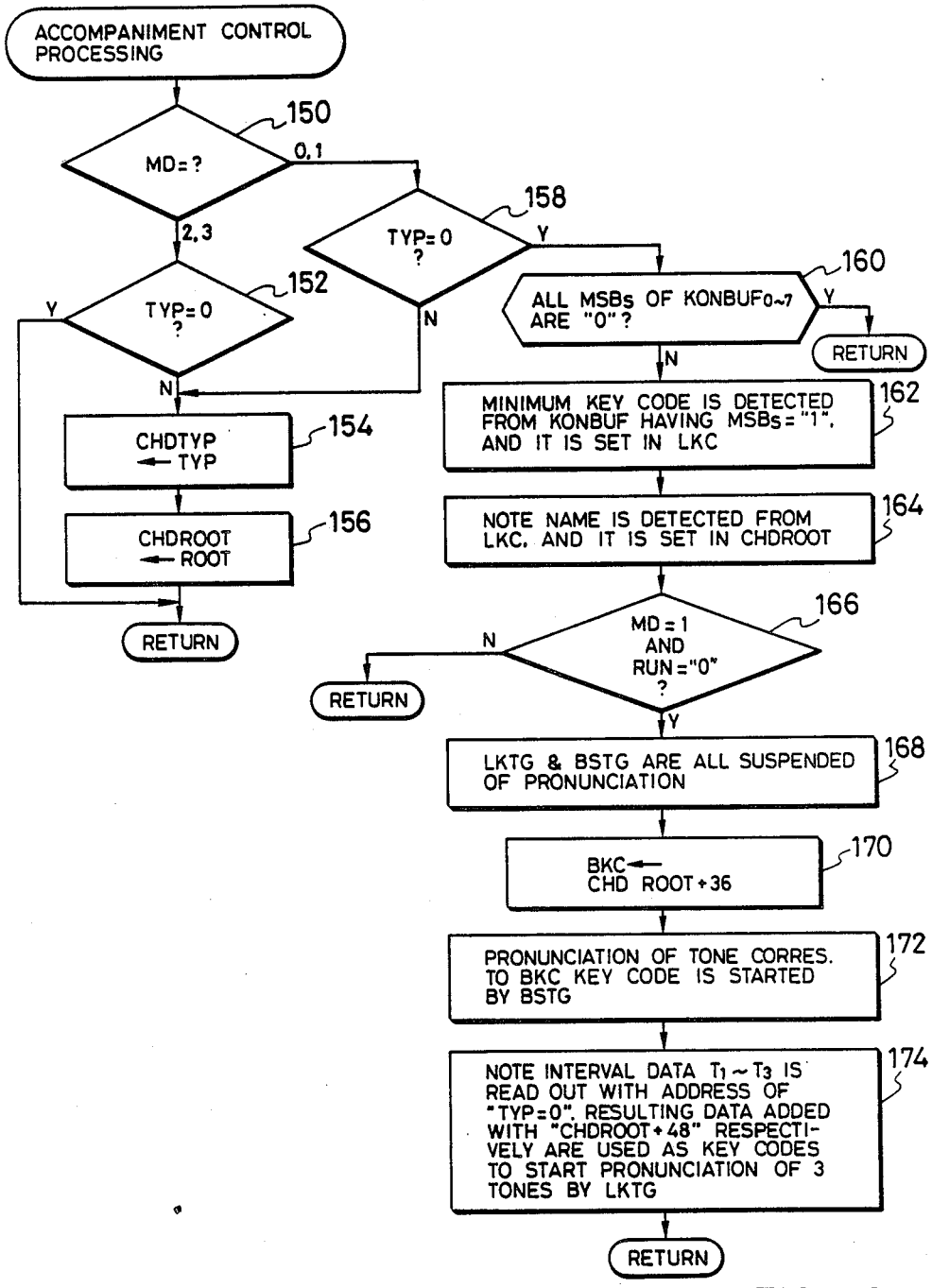
FIG. 9 is a flow chart showing the accompaniment control processing sub-routine.

In Step 70, such an accompaniment control processing as will be described with respect to FIG. 9 is carried out, and thereafter processing moves to Step 72.

In Step 72, judgment is made as to which one of the modes "0"~"3" is indicated by the register MD. If the result of this judgment indicates Mode "1" (ordinary ABC mode), there is no need to cause the generation of manual performance tones, so that processing returns to the routine of FIG. 6.

In case the result of judgment in Step 72 indicates Mode "0" (normal mode) or Mode "3" (manual chord mode), processing moves to Step 74, wherein the pronunciation of the tones corresponding to the key codes of NKC is commenced by LKTG 32. With this, processing returns to the routine of FIG. 6.

If the result of judgment in Step 72 indicates Mode "2" (manual bass mode), processing moves to Step 76, wherein the pronunciation of BSTG 34 is stopped. As a result, if there is any bass tone which is being sounded out, its pronunciation is stopped. With this, processing moves to Step 78, and judgment is made whether the register TYP indicates "0" (whether a chord is not established). If the result of this judgment is negative, (N), this means "establishment of a chord", and processing moves to Step 80.

In Step 80, a value which represents the value of the register CHDROOT added with "36" is loaded on the register BKC. With this, processing moves to Step 82, wherein pronunciation of a bass tone corresponding to the key code of BKC is commenced by BSTG 34. The bass tone which is sounded out at such a time is one belonging to the compass of $C_2\sim B_2$. Thereafter, processing returns to the routine of FIG. 6.

In case the result of judgment in Step 78 is affirmative, (Y), (meaning non-establishment of a chord), processing moves to Step 84, wherein the numerical value obtained by subtracting "12" from the value of NKC (i.e. a tone of one-octave-lowered pitch) is loaded on BKC. With this, processing moves to Step 82, wherein pronunciation of a bass tone corresponding to the key code of BKC is commenced by BSTG 34, and thereafter processing returns to the routine of FIG. 6.

On the other hand, in case the result of judgment in Step 62 is negative, (N), this means that the event is a key-off event, so that processing moves to Step 86.

In Step 86, judgment is made whether $KONBUF_{0\sim7}$ contain a key code identical with that of NKC, and if there is none, (N), processing returns to the routine of FIG. 6. Also, if there is an identical key code, (Y), processing moves to Step 88.

In Step 88, the MSB of the specific KONBUF which is found to contain an identical key code is set to "0". With this, processing moves to Step 90.

In Step 90, judgment is made as to which one of the modes "0"~"3" is indicated by the register. If the result of this judgment indicates Mode "1", processing moves to Step 92, wherein judgment is made whether the MSBs of $KONBUF_{0\sim7}$ are all "0" (no key depression). If the result of this judgment is affirmative, (Y), processing moves to Step 94, wherein pronunciation of all the tone-producing channels of LKTG 32 and the pronunciation of BSTG 34 are stopped. As a result, auto-bass-chord is suspended of its pronunciation.

When the processing in Step 94 is over, or when the result of judgment in Step 92 is negative, (N), processing returns to the routine of FIG. 6.

If the result of judgment in Step 90 indicates either Mode "0" or Mode "3", processing moves to Step 96. In this Step 96, the tone-producing channel of LKTG 32 corresponding to the specific KONBUF whose MSB has been set to "0" is suspended of its tone pronunciation. As a result, the tone of the key released on the lower keyboard is suspended of its pronunciation. After Step 96, processing returns to the routine of FIG. 6.

In case the result of judgment in Step 90 indicates Mode "2", processing moves to Step 98. In this Step 98, judgment is made whether TYP is "0" (non-establishment of a chord). If the result of this judgment is affirmative, (Y), processing moves to Step 100.

In Step 100, judgment is made whether there is coincidence between the numerical value obtained by subtracting "12" from the value of NKC and the value of BKC (as to whether there is agreement between the bass tone of the released key and the bass tone which is being sounded out). If the result of this judgment is affirmative, (Y), processing moves to Step 102, wherein BSTG is suspended of its pronunciation. As a result, the bass tone which has been commenced of its pronunciation in Steps 84, 82, etc. at the time of non-establishment of a chord is suspended of its pronunciation.

When the processing in Step 102 is over, or when the result of judgment in Step 100 is negative, (N), processing returns to the routine of FIG. 6.

In case the result of judgment in Step 98 is negative, (N), this means that a chord is established, so that processing moves to Step 104. In this Step 104, judgment is made whether the MSBs of $KONBUF_{0\sim7}$ are all "0" (no key depression). If the result of this judgment is affirmative, (Y), processing moves to Step 106, wherein BSTG 34 is suspended of its pronunciation of tone. As a result, the bass tone which has been commenced of its pronunciation in Steps 80, 82, etc. at the time of establishment of a chord is now suspended of its tone pronunciation.

When the processing in Step 106 is over, or in case the result of judgment in Step 104 is negative, (N), processing returns to the routine of FIG. 6.

Chord Detection Processing Sub-routine (FIG. 8)

FIG. 8 shows the flow of the chord detection processing. In Step 110, the control variable is assumed to be "i", and it is set to "0", and along therewith "0" is set to the register NTBUF (i.e. "0" is set to each bit).

Next, in Step 112, judgment is made whether the MSB of the "i" -th key-on buffer register $KONBUF_i$ indicates "1" (key-on). If the result of this judgment is affirmative, (Y), processing moves to Step 114, wherein the key code of $KONBUF_i$ is loaded on the register KC. With this, processing moves to Step 116, wherein note name is detected based on the key code of KC, and the detected note name is loaded on the register NOTE. Subsequently thereto, in Step 118, the bit in NTBUF corresponding to the note name of NOTE is set to "1".

When the processing in Step 118 is over, or when the result of judgment in Step 112 is negative, (N), processing moves to Step 120, wherein the value of "i" is incremented by one "1". And, in Step 122, judgment is made whether "i" is eight "8" (meaning whether the search of $KONBUF_{0\sim7}$ is over), and if the result of this judgment is negative, (N), processing returns to Step 112 and those kinds of processing as described above are repeated. As a result, the contents of NTBUF will be reflecting the state of key depression at the time the judgment of the presence of a key-on event was made in Step 62 of FIG. 7. In case three (3) keys of, for example, C-E-G are depressed, those bits corresponding to C, E, G, respectively, will invariably become "1".

Upon completion of search of $KONBUF_{0\sim7}$, the result of judgment in Step 122 will become affirmative, (Y), so that processing moves to Step 124. In this Step 124, the control variable "j" is set to "0", and along therewith "0" is set to the register ROOT.

Next in Step 126, judgment is made whether there is coincidence between the contents of NTBUF and the detected pattern of the pattern number $PTN_{(j)}$ in the chord detection table of FIG. 3. Initially, comparison is made between the detected pattern of "major" which is PTN("0") and the contents of NTBUF. If, at such a time, those bits in NTBUF corresponding to C, E, G as in the preceding example are "1", the result of judgment in Step 126 will accordingly become affirmative, (Y), so that processing moves to Step 128.

In Step 128, chord type number CTN corresponding to $PTN_{(j)}$ is read out from the number conversion table of FIG. 4, and it is loaded on the register TYP. In case of, for example, PTN("0") as stated above, the chord type number CTN="1" corresponding to "major" is set in the register TYP. As a result, it should be assumed that detection has been made of "major" as the chord type, and the note "C" as the root note. Subsequently to Step 128, processing returns to the routine of FIG. 7.

On the other hand, in case the result of judgment in Step 126 is negative, (N), (non-coincidence of pattern), the value of "j" is incremented by one "1" in Step 130 and thereafter processing moves to Step 132, wherein judgment is made whether "j" indicates "11" (whether search has completed, spanning from PTN("0") through to PTN("10"). At the beginning, there is brought about "j"="1" in Step 130, so that the result of judgment in Step 132 becomes negative, (N), and processing returns to Step 126. And, the above-mentioned kinds of processing are repeated until "j"="11" is obtained.

Upon indication of "j"="11", the result of judgment in Step 132 becomes affirmative, (Y), and processing moves to Step 134. This movement of Step indicates the instance that no chord type could have been detected after search ranging from PTN("0")~PTN("10").

Next, after setting "j" to "0" in Step 134, processing moves to Step 136, wherein the data of NTBUF is shifted to the right side by one "1" bit. With this, processing moves to Step 138, wherein the value of ROOT is incremented by one "1". This is the processing for altering the root note name in compliance with the "one-bit" shifting action in NTBUF. Thereafter, processing moves to Step 140.

In Step 140, judgment is made whether the value of ROOT is "12" (whether search has been made ranging from "C" to "B"). First, ROOT="1" (corresponding to C#) is set in Step 138, so that the result of judgment in Step 140 becomes negative, (N), and processing returns to Step 126. And, until ROOT="12" is reached, such kinds of processing as mentioned above are repeated.

As an example, in case the three keys D-F#-A are depressed, it should be noted that, when processing moves to Step 126 after ROOT="2" is reached in Step 138, the result of judgment in Step 126 becomes affirmative, (Y), and in Step 128, CTN="1" corresponding to "major" is set in TYP. As a result, as the chord type, "major" has been detected, whereas as the root note, "D" note has been detected.

In case ROOT="12" is reached in Step 138, the result of judgment in Step 140 becomes affirmative, (Y), and processing moves to Step 142. In this Step 142, "0" is set in TYP on the ground of "non-establishment of a chord", and thereafter processing returns to the routine of FIG. 7.

Accompaniment Control Processing Sub-routine (FIG. 9)

FIG. 9 shows the flow of accompaniment control processing. In Step 150, judgment is made as to which one the modes of "0"~"3" the mode indicated by the register MD. In case the result of this judgment indicates Mode "2" or "3", processing moves to Step 152, wherein judgment is made whether the value of TYP is "0" (non-establishment of a chord).

In case the result of judgment in Step 152 is affirmative, (Y), processing returns to the routine of FIG. 7. Also, when the result of judgment in Step 152 is negative, (N), the chord type data of TYP is set in the register CHDTYP in Step 154, and thereafter the root note data of ROOT is set in the register CHDROOT in Step 156, and thereafter processing returns to the routine of FIG. 7.

As a result, it should be noted that in case of Mode "2" (manual bass mode), the accompaniment pattern of the auto-chord is altered in compliance with the fresh depression of keys provided that a chord has been established, whereas in case of non-establishment of a chord, the accompaniment pattern of the auto-chord remains to be the same as before. Also, in case of Mode "3" (manual chord mode), the accompaniment pattern of auto-bass is altered in correspondence to the fresh depression of keys in case a chord has been established, whereas in case of non-establishment of a chord, the accompaniment pattern of auto-bass remains to be the same as before.

On the other hand, in case the result of judgment in Step 150 indicates either Mode "0" or Mode "1", judgment is made whether TYP="0" is indicated in Step 158. If the result of this judgment is negative, (N), (i.e. establishment of a chord), processing returns to the routine of FIG. 7 after passing through the chord type setting processing and root note setting processing in Step 154 and Step 156 in a manner similar to that described above.

In case the result of judgment in Step 158 is affirmative, (Y), this means "non-establishment of a chord", and processing moves to Step 160. In this Step 160, judgment is made whether all of MSBs of KON- $BUF_{0\sim7}$ are "0" (no key depression). In case the result of this judgment is affirmative, (Y), processing returns to the routine of FIG. 7.

In case the result of judgment in Step 160 is negative, (N), this means such a state of key depression as will cause non-establishment of a chord, so that processing moves to Step 162. In this Step 162, detection is made of the minimum key code (corresponding to the key of the lowest pitch) from KONBUF having MSB="1", and it is inputted in the register LKC. And, processing moves to Step 164, wherein note name is detected based on the key code of LKC, and the detected note name data is entered as the root note data in CHDROOT. As a result, in case of non-establishment of a chord in Mode "1" (ordinary ABC mode), the note name data corresponding to the key of the lowest pitch among the keys being depressed (if the key being depressed is a single key, this latter key) is treated as the root note data. Based on this root note data and the chord type data (value is "0") for non-establishment of a chord, a bass tone is enabled to be sounded out.

Next, in Step 166, judgment is made whether the mode indicated by MD is "1" and also whether the flag RUN indicates "0" (ordinary ABC mode and whether rhythm is suspended). If the result of this judgment is negative, (N), this means either Mode "0" (normal mode) or rhythm is running, so that processing returns to the routine of FIG. 7. In case the result of judgment in Step 166 is affirmative, (Y), processing moves to Step 168.

In Step 168, pronunciation of all the tone-producing channels of LKTG 32 and of BSTG 34 is suspended. As a result, the auto-bass-chord in accordance with an accompaniment pattern is suspended of their pronunciation. Thereafter, processing moves to Step 170, wherein the value obtained by adding "36" to the value of CHDROOT is entered in the register BKC.

Next, in Step 172, a tone corresponding to the key code of BKC is commenced of its pronunciation by BSTG 34. In this case, if, for example, the value of CHDROOT is "0", the note of $C_2$ is sounded out. Thereafter, processing moves to Step 174.

In Step 174, using TYP="0" (chord type data for non-establishment of a chord) as the address, the note interval data $T_1\sim T_3$ is read out from the chord-constituting note table of FIG. 5, and the value obtained by adding (value of CHDROOT+"48") to each of the read-out note interval data is used as the key code, and the resulting tones (notes) are commenced of their pronunciation. In such a case, if the value of CHDROOT happens to be "0", the three notes $C_3$-$E_3$-$G_3$ are sounded out simultaneously. Thereafter, processing returns to the routine of FIG. 7.

Figure 10A:
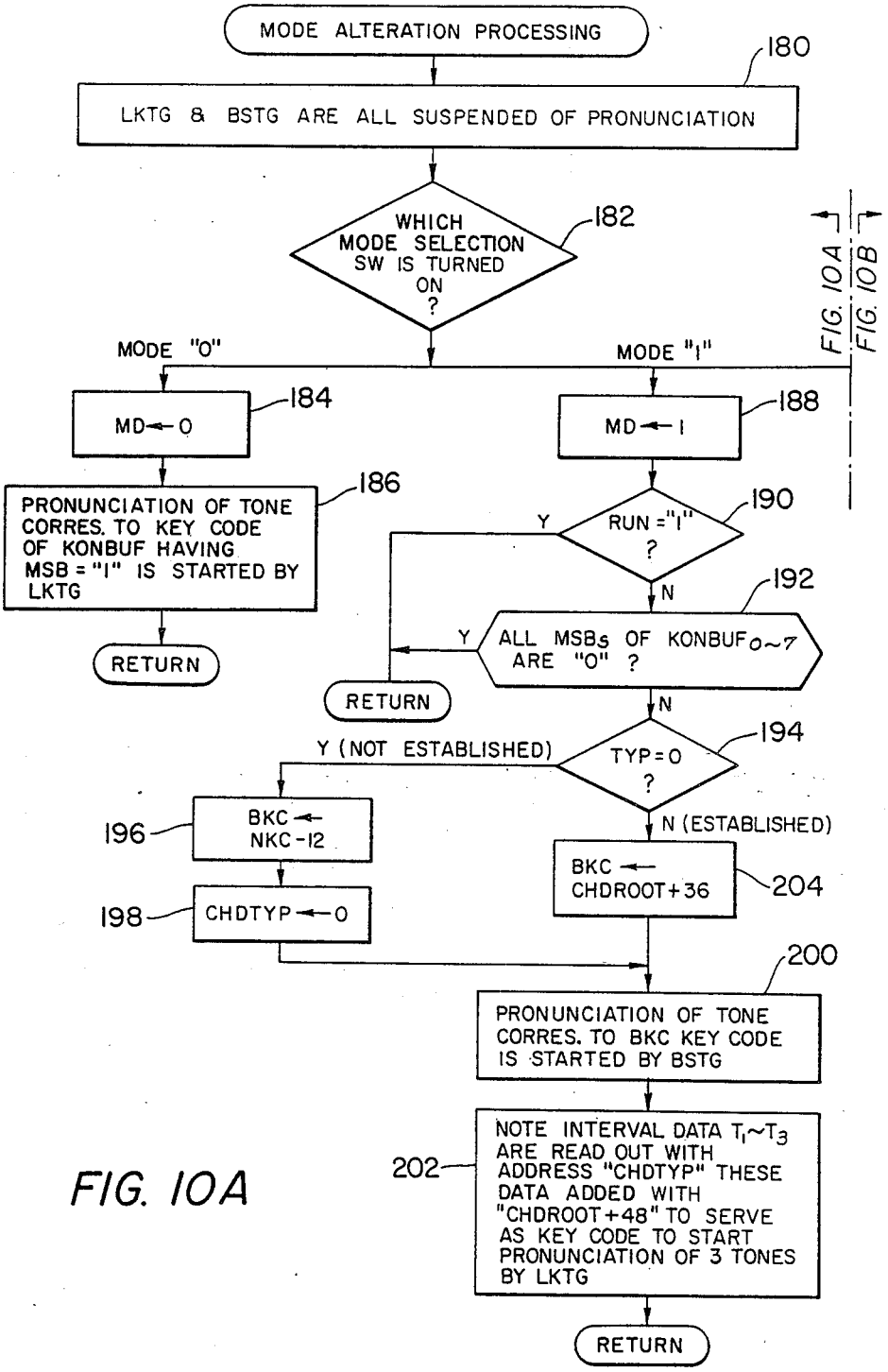

Mode Alteration Processing Sub-routine (FIGS. 10A-B)

FIGS. 10A-B show the flow of the mode alteration processing. In Step 180, all the tone-producing channels of LKTG 32 and BSTG 34 are suspended of their pronunciation. With this, processing moves to Step 182, wherein judgment is made as to which one of the mode selection switches has been turned on.

If the result of judgment in Step 182 indicates that the switch for Mode "0" has been turned on, processing moves to Step 184, wherein "0" is set in MD. With this, processing moves to Step 186, wherein the note corresponding to the key code of the KONBUF having MSB="1" is commenced of its pronunciation by LKTG 32. Thereafter, processing returns to the routine of FIG. 6.

In case the result of judgment in Step 182 indicates that the switch for Mode "1" has been turned on, processing moves to Step 188, wherein "1" is set to MD. With this, processing moves to Step 190, wherein judgment is made whether there is the indication of RUN="1" (whether a rhythm is running). If the result of this judgment is affirmative, (Y), processing returns to the routine of FIG. 6, whereas if the result of judgment is negative, (N), processing moves to Step 192. In this Step 192, judgment is made whether all MSBs of $KONBUF_{0\sim7}$ are "0" (no key depression), and if the result of this judgment is affirmative, (Y), processing returns to the routine of FIG. 6.

In case the result of judgment in Step 192 is negative, (N), this means that a key or keys are depressed during the suspension of a rhythm, so that processing moves to Step 194.

In Step 194, judgment is made whether TYP="0" (non-establishment of a chord). If the result of this judgment is affirmative, (Y), processing moves to Step 196, wherein the value obtained by subtracting "12" from the value of NKC is inputted to BKC. And, processing moves to Step 198, wherein "0" (chord type data for non-establishment of a chord) is set in CHDTYP.

Next, in Step 200, the tone corresponding to the key code of BKC is commenced of its pronunciation by BSTG 34. With this, processing moves to Step 202, wherein using the data of CHDTYP as the address, the note interval data $T_1\sim T_3$ is read out from the chord-constituting note table of FIG. 5, and the value obtained by adding (value of CHDROOT+"48") to each of the read-out note interval data is used as the key code, to thereby cause LKTG 32 to commence the pronunciation of the three tones (notes). Thereafter, processing returns to the routine of FIG. 6.

In case the result of judgment in Step 194 is negative, (N), (meaning: a chord is established), processing moves to Step 204. In this Step 204, the value obtained by adding "36" to the value of CHDROOT is set in BKC. With this, processing returns to the routine of FIG. 6 via the bass tone pronunciation processing and chord tone pronunciation processing of Steps 200 and 202 in a manner similar to that described earlier.

In case the result of judgment in Step 182 indicates that the switch for Mode "2" has been turned on, processing moves to Step 206, wherein "2" is set in MD. And, judgment is made in Step 208 whether all MSBs of $KONBUF_{0\sim7}$ are "0". If "0", (Y), processing returns to the routine of FIG. 6.

In case the result of judgment in Step 208 is negative, (N), this means that key depression is being done, so that processing moves to Step 210. In this Step 210, judgment is made wether TYP="0" (non-establishment of a chord) is indicated.

In case the result of judgment in Step 210 is negative, (N), processing moves to Step 212, wherein the value obtained by adding "36" to the value of CHDROOT is inputted to BKC. With this, processing moves to Step 214, wherein the tone corresponding to the key code of BKC is commenced of its pronunciation by BSTG 34.

In case the result of judgment in Step 210 is affirmative, (Y) processing moves to Step 216, wherein the value obtained by subtracting "12" from the value of NKC is set in BKC. And, after setting "0" in CHDTYP in Step 218, bass tone pronunciation processing is carried out in Step 214 in a manner similar to that described above. Thereafter, processing returns to the routine of FIG. 6.

In case the result of judgment in Step 182 indicates that the switch for Mode "3" has been turned on, processing moves to Step 220, wherein "3" is set in MD. With this, processing moves to Step 222, wherein the tone corresponding to the key code of the KONBUF having MSB="1" is commenced of its pronunciation by LKTG 32. Thereafter, processing returns to the routine of FIG. 6.

Rhythm-on/off Processing Sub-routine (FIG. 11)

FIG. 11 shows the flow of rhythm-on/off processing. In Step 230, the value obtained by subtracting the value of RUN from "1" is set in RUN. With this, processing moves to Step 232, wherein judgment is made whether RUN="1". If the result of this judgment is affirmative, (Y), this means that run of a rhythm has been commanded, and in Step 234 "0" is set in tempo counter CLK. With this, processing returns to the routine of FIG. 6.

In case the result of judgment in Step 232 is negative, (N), this means that suspension of a rhythm has been commanded, and processing moves to Step 236. In this Step 236, judgment is made as to which one of the modes "0"~"3" is indicated by the register MD is. If Mode "0" indicated, processing returns to the routine of FIG. 6.

In case the result of judgment in Step 236 indicates Mode "1", processing moves to Step 238. In this Step 238, pronunciation of all the tone-producing channels of LKTG 32 and BSTG 34 is suspended. As a result, auto-bass-chord is suspended of pronunciation. Thereafter, processing moves to Step 240, wherein the value obtained by adding "36" to the value of CHDROOT is inputted to BKC.

Next, in Step 242, the tone corresponding to the key code of BKC is commenced of its pronunciation by BSTG 34. And, processing moves to Step 244, wherein using the data of CHDTYP as the address, note interval data $T_1 \sim T_3$ is read out from the chord-constituting note table of FIG. 5, and the value of each of the read-out data added with (value of CHDROOOT+"48") is used as the key code, and pronunciation of the three notes is commended by LKTG 32. Thereafter, processing returns to the routine of FIG. 6

In case the result of judgment in Step 236 indicates Mode "2", processing moves to Step 246, wherein all of the tone-producing channels of LKTG 32 are suspended of their pronunciation. As a result, auto-chord is suspended of pronunciation. Thereafter, processing returns to the routine of FIG. 6.

In case the result of judgment in Step 236 indicates Mode "3", processing moves to Step 248, wherein the pronunciation of BSTG 34 is suspended. As a result, auto-bass is suspended of its pronunciation. Thereafter, processing returns to the routine of FIG. 6.

Figure 12:
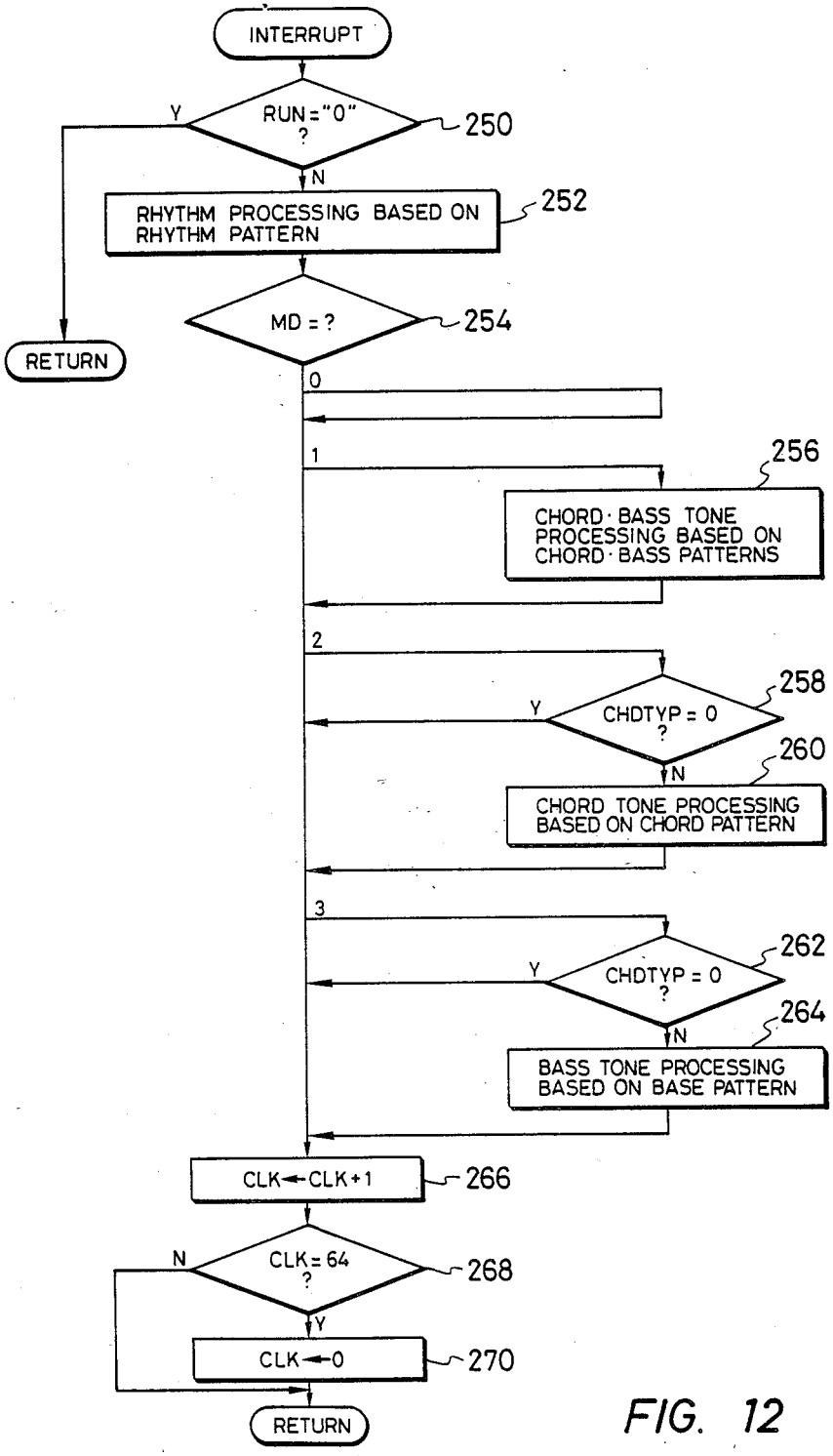
FIG. 12 is a flow chart showing the interrupt routine.

Interrupt Routine (FIG. 12)

FIG. 12 shows the flow of the interrupt processing intended for enabling the performance of auto-rhythm, auto-bass, auto-chord, etc. This interrupt routine is commenced for every pulse of the tempo clock signal TCL.

To begin with, in Step 250, judgment is made whether RUN="0" is indicated. If the result of this judgment is affirmative, (Y), that kind of processing which will be described below s not necessary, so that processing returns to the routine of FIG. 6.

In case the result of judgment in Step 250 is negative, (N), this means that RUN="1" is indicated, so that rhythm tone processing based on a rhythm pattern is carried out in Step 252. That is, in this rhythm tone processing, if there is a percussion instrument tone which is required to be sounded out at a sounding-out timing corresponding to the value of the counter CLK in the rhythm pattern corresponding to the selected rhythm kind, such a percussion tone is sounded out by the rhythm tone generator.

Next, in Step 254, judgment is made as to which one of "0"~"3" is of indicated by MD. In case Mode "0" is indicated by this judgment, processing moves to Step 266.

In case the result of judgment in Step 254 indicates Mode "1", processing moves to Step 256, wherein chord-bass tone processing based on chord-bass pattern is carried out. That is, in this chord-bass tone processing, if there is a note interval data which requires to be commenced of its pronunciation or to be suspended of its pronunciation at a sounding-out timing corresponding to the value of the counter CLK in a chord pattern corresponding to the selected rhythm kind and also to the chord type data of CHDTYP, such a note interval data is added with CHDROOT to determine the key code, whereby the generation of the musical scale tone signal by LKTG 32 is controlled. Along therewith, if there is a note interval data which requires to be commenced of pronunciation or to be suspended of pronunciation at a sounding-out timing corresponding to the value of the counter CLK in a bass pattern corresponding to the selected rhythm kind and also to the chord type data of CHDTYP, such a note interval data is added with CHDROOT to determine the key code, whereby the generation of the musical scale tone by BSTG 34 is controlled. As a result of the processing in Step 256, auto-bass-chord performance is made feasible.

In case the result of judgment in Step 254 is indicative of Mode "2", processing moves to Step 258, wherein judgment is made whether CHDTYP="0" (non-establishment of a chord). And, if the result of this judgment is negative, (N), processing moves to Step 260, wherein chord processing based on a chord pattern is carried out. This chord processing is a processing similar to that described with respect to chord pattern in Step 258, whereby auto-chord performance is made feasible.

In case the result of judgment in Step 254 indicates Mode "3", processing moves to Step 262, wherein judgment is made whether CHDTYP="0" is indicated. If the result of this judgment is negative, (N), processing moves to Step 264, wherein bass tone processing based on a bass pattern is carried out. This bass tone processing is one similar to that described with respect to bass pattern in Step 256, whereby making an auto-bass performance feasible.

Upon completion of the processing in Steps 256, 260 or 264, or when the result of judgment in Step 258 or 262 is affirmative, (Y), processing moves to Step 266.

The reason why arrangement is made so as to avoid the processing in Step 260 or 264 when CHDTYP is "0" in Step 258 or 262, respectively, in case of Mode "2" or "3" as stated above is to cause either an auto-chord or auto-bass performance to be started under the condition that a chord is established at the initializing time or at such a mode setting time as shown in FIG. 10. After an auto-chord or auto-bass performance has been started in this way, TYP="0" is no longer set in CHDTYP in accordance with the Step 152 of FIG. 9. Therefore, even when a chord is not established, an auto-chord or auto-bass performance is continued, respectively, exactly in the same chord pattern or bass pattern as before. At such an occasion, manual performance tones are generated also as has been described with respect to FIG. 7.

In Step 266, the value of CLK is incremented by "1". And, processing moves to Step 268, wherein judgment is made whether the value of CLK is "64" (end of two bars). If the result of this judgment is negative, (N), processing returns to the routine of FIG. 6, whereas in case it is affirmative, (Y), CLK is reset to "0" in Step 270, and thereafter processing returns to the routine of FIG. 6. Accordingly, such a performance as auto-rhythm, auto-bass, auto-chord, etc. is repeated for every two bars (measures).

Modified Embodiment

The present invention is not limited to those embodiments described above, but it can be put to practice in various modified forms. For example, the following modification is feasible.

(1) In the earlier-described embodiments, manual bass mode and manual chord mode are shown exemplarily. Arrangement may be made, however, that at the time of establishment of a chord, chord tones and bass tones are generated as automatic accompaniment tones, whereas at the time of non-establishment of a chord, the pronunciation of either one of the parts (chord tones or bass tones) of automatic accompaniment is inhibited to thereby enable this inhibited part for making manual performance. Also, arrangement may be provided so that at the time of establishment of a chord, chord tones and bass tones are generated as the automatic accompaniment tones, whereas at the time of non-establishment of a chord, such tones as obligato, etc. may be generated as manual performance tones corresponding to the depressed keys.

(2) In the earlier-described embodiments, arrangement has been provided so that when a chord is established during the manual bass mode, the root note thereof is sounded out as the bass tone. However, such sounding-out of bass tone may be omitted to sound out only the chord tones.

(3) During the running of a rhythm, such automatic accompaniment tones as chord tones, bass tones, etc. may be provided as continuing tones without beating with rhythms.

(4) Arrangement may be provided so that during the manual mode such as manual bass, manual chord, etc., the generation of automatic accompaniment tones is suspended on the condition of non-establishment of a chord or no key-depression on the keyboard.

What is claimed is:

1. An automatic accompaniment apparatus for use in or with an electronic musical instrument, comprising:

a keyboard;

detecting means connected to said keyboard for detecting a chord type based on key-depression signals supplied from said keyboard;

judging means connected to said detecting means for judging whether said detecting means has detected a predetermined chord type;

accompaniment tone generating means connected to said detecting means and to said judging means for generating, when the result of judgment made by said judging means is affirmative, accompaniment tones in accordance with an accompaniment pattern corresponding to the detected chord type; and manual tone generating means connected to said keyboard and to said judging means for generating based on said key-depression signals, when the result of judgment made by said judging means is negative, musical tones in accordance with each of the depressed keys, each tone individually corresponding to a respective one of the depressed keys.

2. An automatic accompaniment apparatus according to claim 1, in which:

said accompaniment tone generating means is arranged to be operative so that, when said result of judgment is negative, the generation of the accompaniment tones continue with the accompaniment pattern which has been running till then.

3. An automatic accompaniment apparatus for use in or with an electronic musical instrument, comprising:

a keyboard including keys and delivering key-depression signals indicative of depressed ones among said keys;

detecting means connected to said keyboard for detecting a state of the depression of said keys based on said key-depression signals supplied from said keyboard;

judging means connected to said detecting means for judging whether said detecting means has detected a predetermined state of the key depression by comparison with memorized states;

first tone generating means connected to said detecting means and to said judging means for generating, when the result of judgment made by said judging means is affirmative, tones of automatic performance in accordance with a predetermined performance pattern corresponding to the detected state; and second tone generating means connected to said keyboard and to said judging means for generating based on said key-depression signals, when the result of judgment made by said judging means is negative, individual tones of manual performance in accordance with each of the depressed keys, each tone corresponding to a respective one of the depressed keys.

* * * * *